United States Patent [19]

Tokura et al.

[11] Patent Number: 4,674,467

[45] Date of Patent: Jun. 23, 1987

[54] APPARATUS FOR CONTROLLING IGNITION IN INTERNAL COMBUSTION ENGINE

[75] Inventors: Norihito Tokura, Aichi; Hisasi Kawai, Toyohashi; Masahiro Goto, Aichi, all of Japan

[73] Assignee: Nippon Soken, Inc., Nishio, Japan

[21] Appl. No.: 849,377

[22] Filed: Apr. 8, 1986

[30] Foreign Application Priority Data

Apr. 10, 1985 [JP] Japan ..... 60-76184

[51] Int. Cl.[4] ..... F02P 3/12

[52] U.S. Cl. ..... 123/644; 123/655; 123/606

[58] Field of Search ..... 123/644, 655, 606, 637, 123/640, 621; 315/209 T, 206; 331/114

[56] References Cited

U.S. PATENT DOCUMENTS

| | | | |
|---|---|---|---|
| 3,035,108 | 5/1962 | Kachni | 123/637 |
| 3,910,247 | 10/1975 | Hartig | 123/655 |
| 4,138,977 | 2/1979 | Grather et al. | 123/637 |
| 4,245,594 | 1/1981 | Morino et al. | 123/606 |
| 4,356,807 | 11/1982 | Tokura et al. | 123/606 |
| 4,378,779 | 4/1983 | Hachiga et al. | 123/644 |
| 4,403,591 | 9/1983 | Weber | 123/644 |
| 4,403,592 | 9/1983 | Fritz | 123/644 |
| 4,440,130 | 4/1984 | Taguchi et al. | 123/644 |
| 4,552,118 | 11/1985 | Fukaya | 123/644 |

*Primary Examiner*—Raymond A. Nelli

*Attorney, Agent, or Firm*—Cushman, Darby & Cushman

[57] ABSTRACT

The apparatus includes an ignition instruction signal generating unit for repeatedly generating a first ignition instruction signal instructing an AC discharging duration and a second ignition instruction signal instructing the current flow time of a first primary coil at each ignition timing; and an ignition control circuit unit for causing the first and second switching elements to perform a push-pull operation for a predetermined period of time upon reception of a given ignition instruction signal. When it is detected from a current detection signal from the current detection element upon reception of the first ignition instruction signal that the current of one of the first and second closed circuits has reached a predetermined value, a signal for turning OFF the one of the first and second closed circuits is supplied to one of the first and second switching elements and a signal for turning ON the other closed circuit is supplied to the other switching element so as to enable the push-pull operation of the switching elements. Accordingly, one of the switching elements is turned ON in response to the second ignition instruction signal for the current flow time of the primary thereby, and is then turned OFF. Thus, an ignition timing can be determined precisely, and a sufficiently high voltage can be obtained.

9 Claims, 10 Drawing Figures

APPARATUS FOR CONTROLLING IGNITION IN INTERNAL COMBUSTION ENGINE

BACKGROUND OF THE INVENTION

1. Field of the Invention

The present invention relates to an apparatus for controlling ignition in an internal combustion engine. The apparatus according to the present invention is used in an AC continuous-discharge type ignition apparatus for restricting the primary coil current of an ignition coil.

2. Description of the Related Art

In a conventional AC continuous-discharge type ignition apparatus for a spark ignition type internal combustion engine, the discharge duration of a spark plug can be prolonged during a single combustion cycle of the engine, as needed. The apparatus has a high average discharging current, e.g., 50 mA or higher, and allows easy ignition of a fuel-air mixture.

However, the conventional ignition apparatus generates only one ignition instruction signal. When this signal is at H level, there is a delay time of 0.5 to 1 msec from when the apparatus is rendered conductive until ignition start time. Therefore, spark timings cannot be controlled accurately. In addition, since ignition energy for the first discharge is insufficient, a sufficiently high voltage cannot be generated.

The conventional ignition apparatus is disclosed in, for example, U.S. Pat. No. 4,356,807.

SUMMARY OF THE INVENTION

It is an object of the present invention to provide an improved ignition control apparatus which is free from the above problem and in which a second ignition instruction signal for indicating an ignition timing is generated to control the ignition timing and to increase ignition energy for the first discharge, so that an optimal ignition can be carried out in an internal combustion engine, thereby improving the fuel consumption ratio and reducing harmful components in the exhaust gas.

DESCRIPTION OF THE PREFERRED EMBODIMENTS

Figure 1:
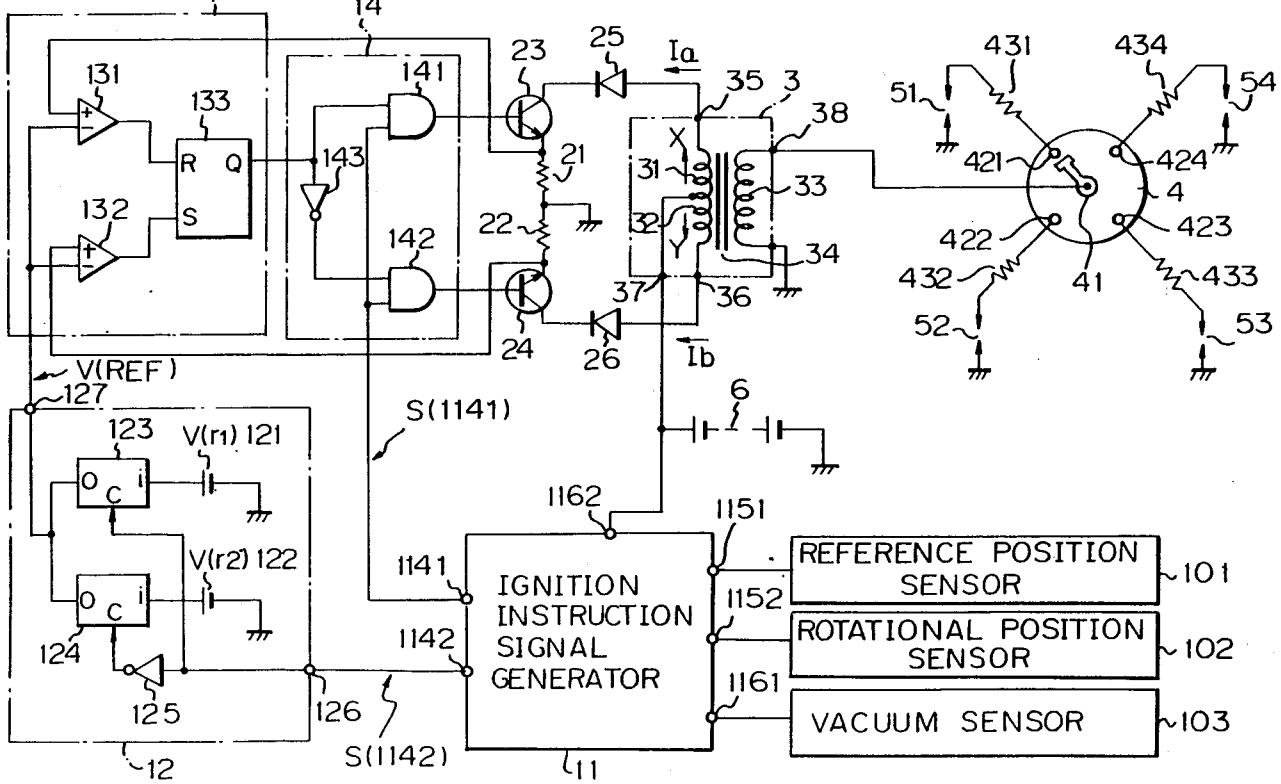
FIG. 1 is a schematic diagram of an ignition control apparatus for an internal combustion engine according to an embodiment of the present invention.

FIG. 1 shows an ignition control apparatus for an internal combustion engine according to an embodiment of the present invention. Referring to FIG. 1, reference numeral 11 denotes an ignition instruction signal generator as an ignition instruction signal generating means for generating an ignition instruction signal; 12, a reference voltage generator as a preset value generating circuit; 13, a discriminator; and 14, a logic circuit. An AND gate 141 in the circuit 14 produces an AND product of a first ignition instruction signal generated from a terminal 1141 of the generator 11 and the output signal from the discriminator 13. When the first ignition instruction signal is "1" level, the AND gate 141 passes the output pulse signal from the discriminator 13 therethrough. When this signal is "0" level, the AND gate 141 generates a "0" level signal.

An AND gate 142 produces an AND product of the first ignition instruction signal and the output signal from a NOT gate 143, which is the inverted output signal from the discriminator 13. When the first ignition instruction signal is "1" level, the AND gate 142 passes the output pulse signal from the NOT gate 143 therethrough. When this signal is "0" level, the AND gate 142 generates a "0" level signal.

Reference numerals 23 and 24 denote power transistors acting as first and second switching elements. The bases of the power transistors 23 and 24 are connected to the output terminals of the AND gates 141 and 142, respectively. The collectors of the power transistors 23 and 24 are respectively connected to primary terminals 35 and 36 of primary coils 31 and 32 in an ignition coil 3 through diodes 25 and 26, which prevent reverse current flow. In this case, the collectors of the transistors 23 and 24 are connected to the cathodes of the diodes 25 and 26, respectively. The emitters of the power transistors 23 and 24 are connected to the ground potential through current detection resistors 21 and 22, which have a small resistance and act as current detection elements.

The ignition coil 3 comprises the primary coils 31 and 32 having a turn ratio of about 300, a secondary coil 33, and an iron core 34. The primary coils 31 and 32 are magnetically coupled to the secondary coil 33 through the iron core 34. The coil 3 transforms a voltage generated at the primary coils 31 and 32 and generates it from the secondary coil 33. The terminals 35 and 36 of the primary coils 31 and 32 are connected to the anodes of the diodes 25 and 26, and an intermediate terminal 37 thereof is connected to the positive terminal of a battery 6. The negative terminal of the battery 6 is connected to the ground potential.

An output terminal 38 of the secondary coil 33 of the ignition coil 3 is connected to a center electrode 41 of a distributor 4. The center electrode 41 is rotated in synchronization with the rotation of the engine so as to distribute high voltages over side electrodes 421 to 424. Spark plugs 51 to 54 arranged in respective cylinders of the engine are connected to the side electrodes 421 to 424 of the distributor 4 through high voltage cables 431 to 434, respectively.

The discriminator 13 detects voltage drops across the resistors 21 and 22, thus discriminating the level of primary coil currents Ia and Ib from the ignition coil 3. In the discriminator 13, the voltage across the resistor 21 is applied to the non-inverting input terminal of a comparator 131. A reference voltage V(REF) corresponding to a preset current value from a terminal 127 of the generator 12 is applied to the inverting input terminal of the comparator 131. The comparator 131 then compares both voltages. If the terminal voltage is higher than the reference voltage V(REF), the comparator 131 generates a "1" level signal; otherwise, it generates a "0" level voltage. A comparator 132 receives the terminal voltage from the resistor 22 at its non-inverting input terminal, and also receives the reference voltage V(REF) from the terminal 127 of the generator 12 at its inverting input terminal. If the terminal voltage is higher than the reference voltage V(REF), the comparator 132 generates a "1" level signal; otherwise, it generates a "0" level signal. An RS flip-flop 133 has a terminal S as a set terminal, a terminal R as a reset input terminal, and a terminal Q as an output terminal. The terminals S and R of the flip-flop 133 are connected to the output terminals of the comparators 132 and 131, respectively. If the comparator 131 generates a "1" level signal, the terminal Q generates a "0" level signal. If the comparator 132 generates a "1" level signal, the terminal Q generates a "1" level signal.

In the generator 12, output terminals O of two analog switches 123 and 124 are commonly connected to the terminal 127. Reference voltage V(r1) and V(r2) are respectively applied to the input terminals of the switches 123 and 124. A terminal 126 of the generator 12 is connected to a control terminal C of one analog switch 123, and is connected to a control terminal C of the other analog switch 124 through a NOT gate 125. When the terminal 126 is "1" level, the switches 123 and 124 are ON and OFF, respectively, and the reference voltage V(REF) generated from the terminal 127 becomes equal to one reference voltage V(r1). In contrast, when the terminal 126 is "0" level, the analog switches 123 and 124 are respectively OFF and ON, and the reference voltage V(REF) becomes equal to the other reference voltage V(r2). Therefore, the generator 12 can selectively set the reference voltage V(REF) at V(r1) and V(r2) in accordance with the level of the second ignition instruction signal applied to the terminal 126.

A reference position sensor 101 and a rotational angle sensor 102 are of a known magnet pickup type and can generate pulse signals in synchronism with the engine. The sensor 101 generates a pulse every 180° CA (crank angle), and the sensor 102 generates a pulse every 30° CA. The pulses from sensors 101 and 102 are respectively supplied to terminals 1151 and 1152 of generator 11.

A vacuum sensor 103 is a known semiconductor diaphragm type pressure sensor, and generates an analog voltage which is proportional to the intake pipe vacuum of the engine (not shown) and is supplied to a terminal 1161 of the generator 11. A terminal 1162 of the generator 11 is connected to the positive terminal of the battery 6.

The generator 11 carries out calculations in accordance with the output signals from the sensors 101, 102, and 103, and the battery voltage, and generates the first and second ignition instruction signals from the terminals 1141 and 1142, respectively.

Figure 2:
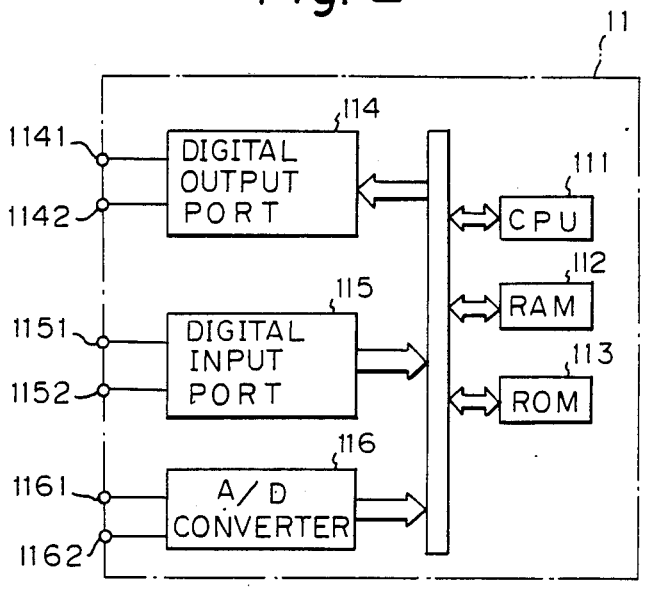
FIG. 2 is a detailed circuit diagram of an ignition instruction signal generator in the apparatus of FIG. 1.

FIG. 2 shows the arrangement of the ignition instruction signal generator 11. The generator 11 is a computer system comprising a central processing unit (CPU) 111, a RAM 112, and a ROM 113, and the like. A digital input port 115 of the generator 11 fetches the pulse signals generated by the sensors 101 and 102 from the terminals 1151 and 1152.

A digital output port 114 generates the first and second ignition instruction signals from the terminals 1141 and 1142, respectively. An A/D converter 116 receives the voltage signal from the negative pressure sensor 103 and the voltage of the battery 6 from the terminal 1162, and converts them to digital signals.

Figure 8:
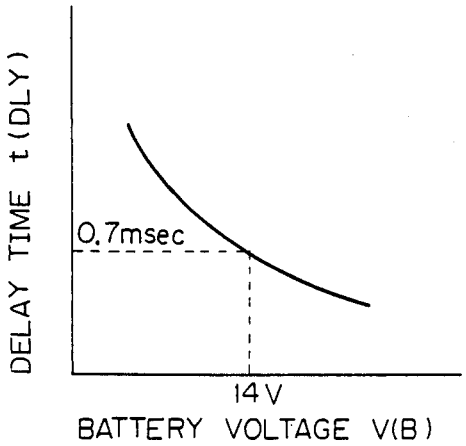
FIG. 8 shows a graph of the relationship between a delay time and a battery voltage.
Figure 3:
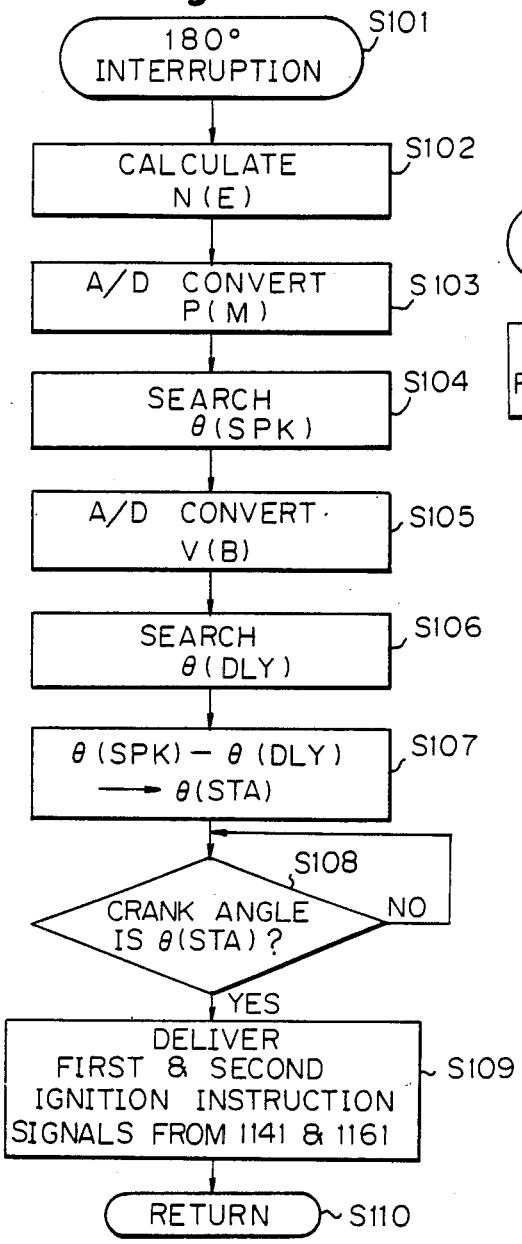
FIGS. 3 and 4 are flow charts for explaining the operation of the ignition instruction signal generator.

The operation of the apparatus in FIG. 1 will now be described with reference to FIGS. 3 to 7. FIG. 3 is a flow chart showing the calculation processing of the generator 11. The operation of the generator 11 will first be described with reference to the waveform chart in FIG. 5. During the operation of the engine, reference signals at every 180° CA and angle signals at every 30° CA are supplied to the generator 11, as shown in FIGS. 5(1) and 5(2). As shown in FIG. 3, a 180° interruption step S101 starts in response to the 180° CA reference signal generated at time t0. In step S102, a rotational speed N(E) is calculated by a reciprocal operation from the time required for rotating the crank shaft through 180°. In step S103, a signal corresponding to an intake pipe negative pressure P(M) is fetched, and is converted to a digital signal. In step S104, an optimal ignition timing $\theta$(SPK) is searched from a two-dimensional map based on a rotational speed N(E) and the intake pipe negative pressure P(M). In step S105, a battery voltage V(S) is fetched and is converted to a digital signal. In the primary coil 3, there is a delay time t(DLY) from when the primary coils begin to be energized until a high voltage appears at the secondary coil. The delay time t(DLY) changes with changes in a battery voltage V(B), as shown in FIG. 8. Therefore, a current start timing $\theta$(STA) of the primary coils of the ignition coil 3 must be shifted earlier than the ignition timing $\theta$(SPK) by a delay angle $\theta$(DLY) corresponding to the delay time t(DLY). For this purpose, in step S106, the optimal delay angle $\theta$(DLY), which is searched from the two-dimensional map based on the rotational speed N(E) and the battery voltage V(B), is subtracted from the ignition timing $\theta$(SPK), thus obtaining the current start timing $\theta$(STA). In step S108, it is discriminated if the crank angle of the engine coincides with the current start timing $\theta$(STA). If YES in step S108, the flow advances to step S109. In step S109, the second ignition instruction signal for generating a "1" level signal during a period from timing t1 which is a current start timing $\theta$(STA) to timing t2 which is an ignition timing $\theta$(SPK) and the first ignition instruction signal for generating a "1" level signal during a period from timing t1 to timing t3 which is discharge termination timing $\theta$(STP) are delivered from the terminals 1141 and 1142, respectively. Then, the flow returns to step S110.

Figure 4:
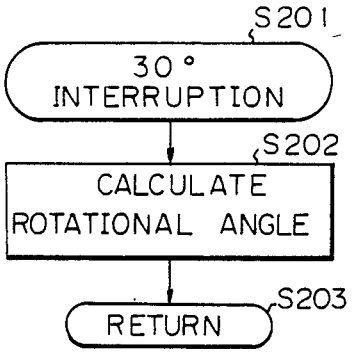
Figure 5:
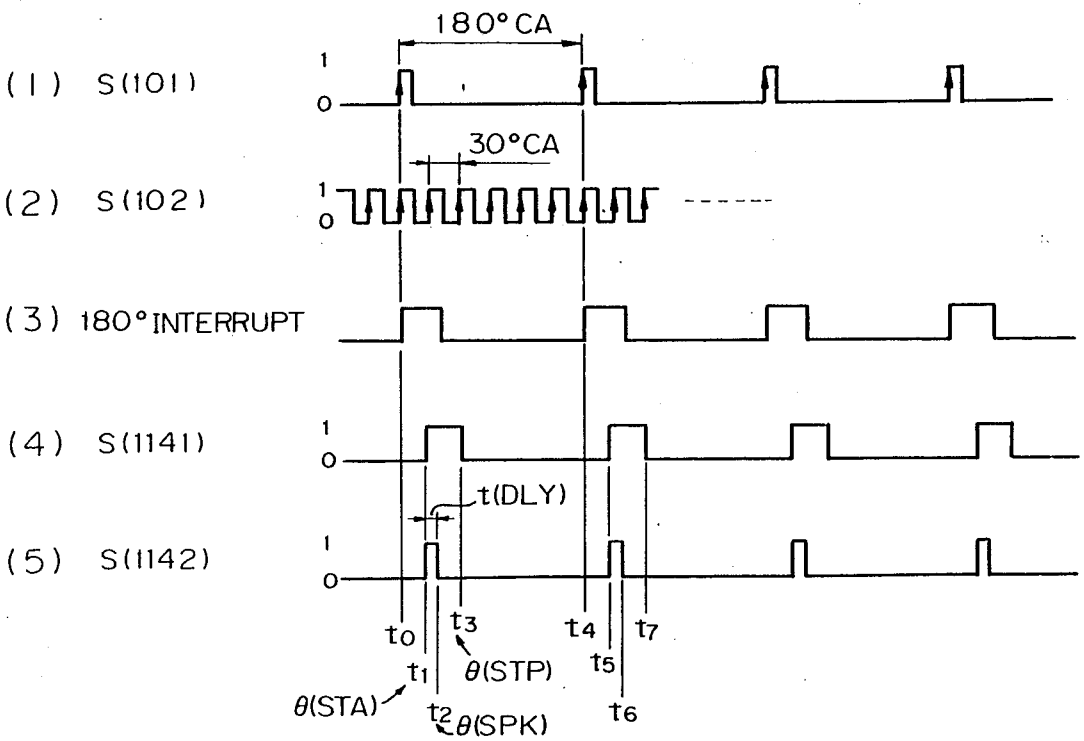
FIGS. 5 and 6 are signal waveform charts of the apparatus of FIG. 1.

A 30° interrupt routine shown in FIG. 4 starts from step S201 every 30° CA in response to the signal from the rotational angle sensor 102, as shown in FIG. 5(2). In step S202, the rotational angle is calculated to provide the angle necessary for calculation of the crank angle in step S108 of the main routine. The flow then returns to step S203.

The operation of the ignition apparatus will now be described with reference to the waveform charts in FIGS. 6 and 7. FIG. 7 is an enlargement of a part of FIG. 6.

Figure 6:
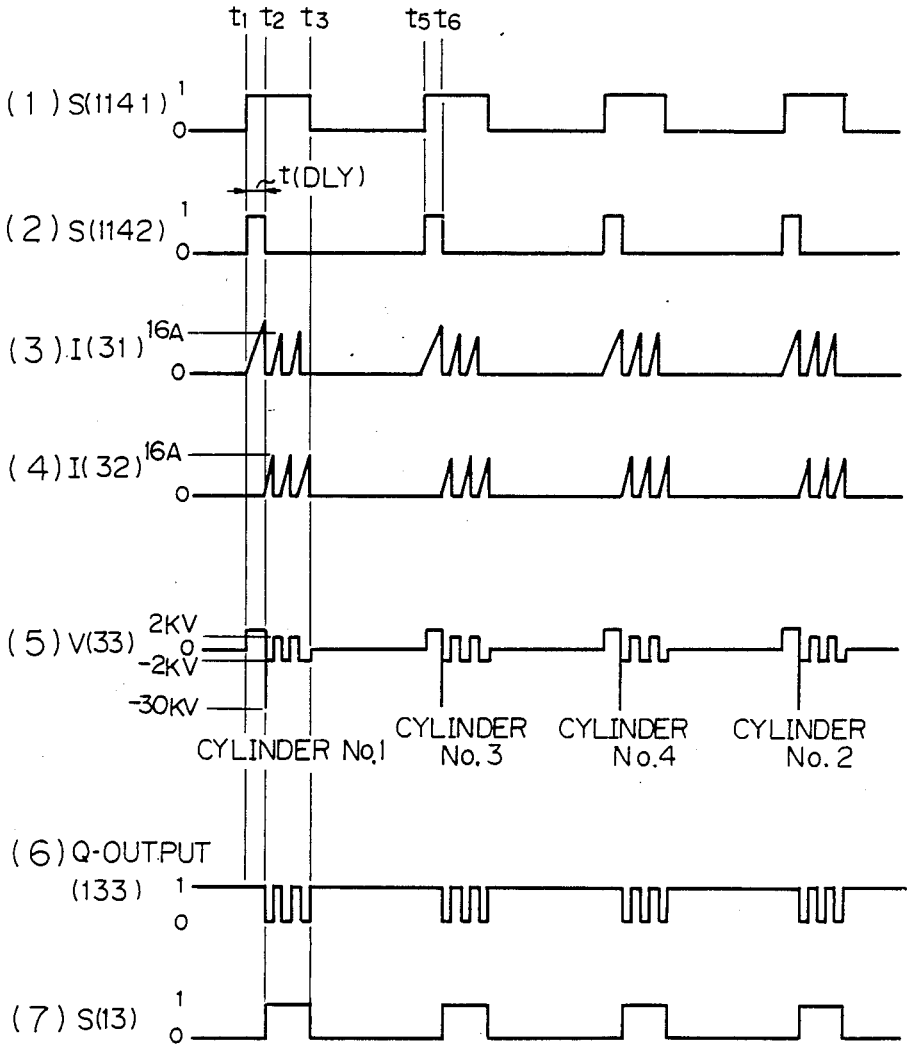
Figure 7:
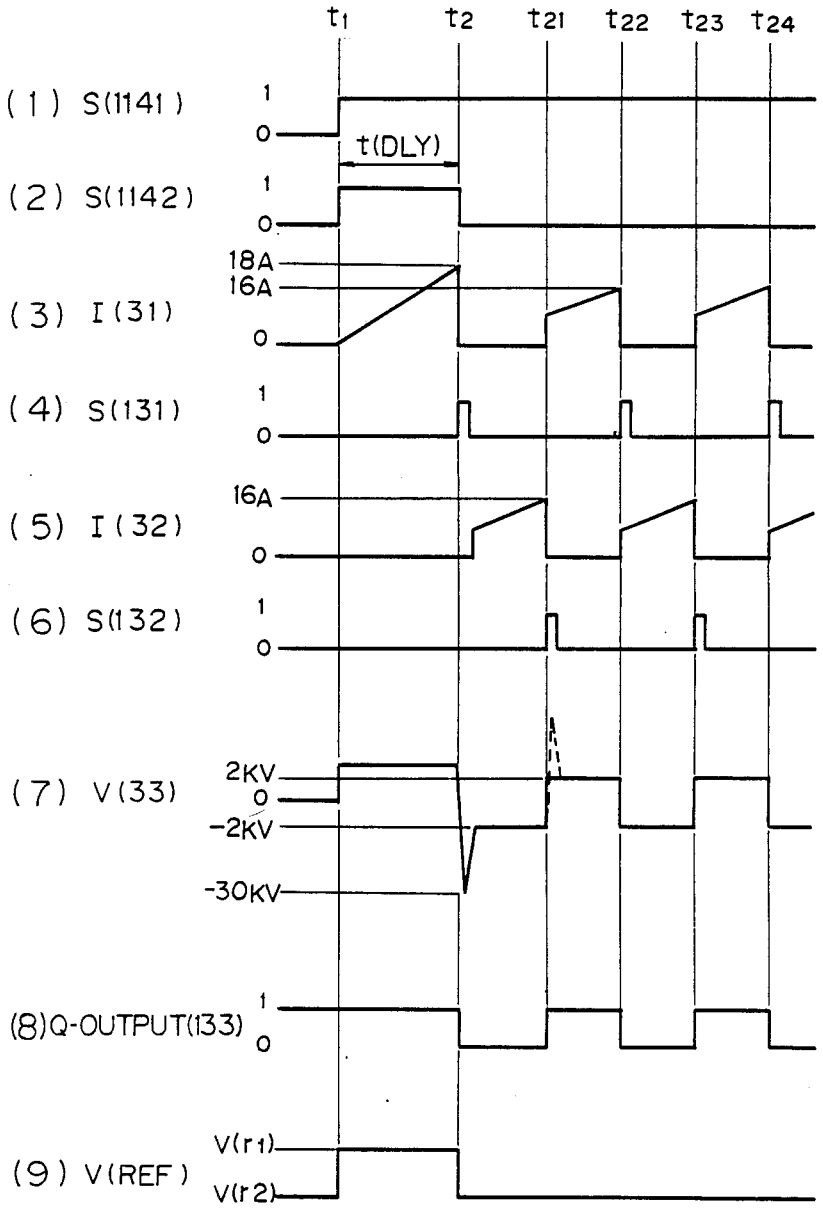
FIG. 7 shows enlarged waveforms of the waveforms in FIG. 6.

The first and second ignition instruction signals shown in FIGS. 6(1) and 6(2) are generated from the terminals 1141 and 1142 of the generator 11 in synchronism with the engine rotation. More specifically, the generator 11 generates a "1" level signal during an interval corresponding to the delay time t(DLY) from the terminal 1142. In summary, the discriminator 13 generates a rectangular-wave pulse signal shown in FIG. 6(7) at a frequency of 1 to 5 kHz, determined by the design of the circuit containing the ignition coil 3, during an interval from t2 to t3, and an inverter 143 generates an inverted signal of this pulse signal. These signals are applied to the bases of the transistors 23 and 24 through the AND gates 141 and 142, so that the transistors 23 and 24 are alternatively turned ON and OFF during the interval from t1 to t3, thus enabling the push-pull operation. Thereby, the currents shown in FIGS. 6(3) and 6(4) flow through the primary coils 31 and 32 of the ignition coil 3, and a high voltage is generated from the secondary coil 33, as shown in FIG. 6(5), thus causing the spark plugs 51 to 54 discharge.

FIG. 7 is an enlargement of a part of FIG. 6 during the period from t1 to t3. When the first ignition instruction signal shown in FIG. 7(1) goes to "1" level at time t1, the transistor 23 is turned ON, and the current Ia flowing through the primary coil 31 increases with time, as shown in FIG. 7(3). During the interval from t1 to t3 (i.e., the delay time t(DLY)), since the second ignition instruction signal is at "1" level, as shown in FIG. 7(2), the reference voltage V(REF) becomes equal to the voltage V(r1) higher than V(r2), as shown in FIG. 7(9). When the primary coil current Ia is 16 A, the reference voltage V(r1) is set high enough to compensate for the voltage drop, corresponding to the voltage V(r2), across the resistor 21. Therefore, before time t2, even if the current Ia reaches 18 A, the output from the comparator 131 is kept at the "0" level, as shown in FIG. 7(3).

The reference voltage V(REF) is switched from the voltage V(r1) to V(r2) at timing t2, as shown in FIG. 7(9). The reference voltage V(r2) is set to be equal to the voltage drop across the resistor 21 when the current Ia is 16 A. Therefore, since the voltage drop across the resistor 21 corresponding to the current Ia becomes larger than the reference voltage V(REF) which is equal to V(r2) after timing t2, the comparator 131 generates a pulse signal at timing t2, as shown in FIG. 7(4). Since the pulse signal is supplied to the terminal R of the flip-flop 133, the output from the terminal Q thereof goes to the "0" level at timing t2, as shown in FIG. 7(8), thus turning OFF the transistor 23. Therefore, the current Ia abruptly decreases immediately after it reaches the maximum value 18 A, as shown in FIG. 7(3). As a result, a counterelectomotive force is generated in the primary coil 31 in the direction indicated by arrow X in FIG. 1, and a high trigger voltage of about −30 kV appears across the terminal 38 of secondary coil 33, as shown in FIG. 7(7). This high voltage causes the spark plug 51 in the first cylinder to start discharging through the distributor 4 and the high voltage cable 431. Thereafter, a constant voltage of about −2 kV is generated. In this way, since the current Ia of the primary coil 31 is set at the maximum value 20 A, a sufficiently high energy accumulates in the ignition coil 3 to generate a high trigger voltage and obtain enough energy for the first discharge. After the discharging, the transistor 24 is electrically connected to the diode 26, and the current Ib from the primary coil 32 increases with time as shown in FIG. 7(5).

The resistance of the resistor 22 is set such that the voltage drop across the resistor 22 becomes equal to the reference voltage V(REF) which is equal to V(r2) when the current Ib has reached 16 A at timing t21. Therefore, since the voltage drop across the resistor 22 corresponding to the current Ib becomes higher than the reference voltage V(REF) which is equal to V(r2) after timing t21, the comparator 132 generates a pulse signal at timing t21, as shown in FIG. 7(6). When the pulse signal is supplied to the terminal S of the flip-flop 133, the output from the terminal Q goes to the "1" level, thus turning OFF the transistor 24. Therefore, the current Ib of the primary coil 32 abruptly decreases immediately after it reaches the maximum value 16 A, as shown in FIG. 7(5). As a result, a counterelectromotive force is generated from the primary coil 32 in the direction indicated by arrow Y in FIG. 1. If discharging of the spark plug 51 is interrupted at timing t21, the terminal 38 of the primary coil 33 generates a high positive trigger voltage, thus resuming the discharging operation of the plug 51. However, if the discharging operation is maintained at timing t21, no trigger voltage is generated from the terminal 38 of the primary coil 33, and the voltage from the coil 33 is switched from a negative voltage of about −2 kV to a positive voltage of about +2 kV, as indicated by the solid lines in FIG. 7(7).

After timing t21, the current Ia of the primary coil 31 flows as shown in FIG. 7(3), and the discharging operation of the spark plug 51 can be thereby maintained. After time 21, the current Ia of the primary coil 31 increases with time, as shown in FIG. 7(3).

When the current Ia of the primary coil 31 reaches 16 A at time t22, the comparator 131 generates the pulse signal shown in FIG. 7(4), and the output from the terminal Q of the flip-flop 133 goes to the "0" level. In contrast to this, the output voltage from the secondary coil 33 is switched from +2 kV to −2 kV, as shown in FIG. 7(7), thus maintaining the discharging operation of the spark plug 51. The above-mentioned operation is also repeated after timing t22, as shown in FIG. 7. In this way, the spark plug 51 can carry out a continuous AC discharge while the first ignition instruction signal is kept at the "1" level.

The diode 26 is connected between the primary coil 32 and the collector of the transistor 24. Since this diode 26 interrupts the electrical connection between the base and collector of the transistor 24, to prevent the absorption of a high negative pulse voltage, a counterelectromotive force in the direction X can be stably generated from the primary coil 31, and a high negative trigger voltage is generated from the secondary coil 33. The diode 25 is connected between the primary coil 31 and the collector of the transistor 23. Since the diode 25 similarly interrupts the electrical connection between the base and collector of the transistor 23 to prevent the absorption of a high positive pulse voltage, a counterelectromotive force in the direction Y can be stably generated from the primary coil 32 at time t21. When the discharging operation of the spark plug 51 is stopped, a high positive trigger voltage is generated from the secondary coil 33; when not stopped, the polarity of the voltage is switched to maintain the discharging operation of the plug 51. In this way, a high trigger voltage can be generated stably and continuous discharging is possible, due to the presence of the diodes 25 and 26.

From the above descriptions, the spark plug 51 performs a capacitive discharging operation by the high trigger voltage of −30 kV from the secondary coil 33, and thereafter maintains the operation with a 2 kV constant voltage. It should be noted that a sufficiently high trigger voltage and spark energy for the first discharge operation can be obtained, and that the trigger voltage and the continuous discharging voltage are repeatedly generated. Thus, even if the discharging operation of the spark plug 51 is temporarily interrupted by an irregular airflow in a combustion chamber of the engine, a high trigger voltage is generated by the switching operation performed slightly thereafter, thus immediately resuming the discharging operation. The above descriptions are related to the discharging operation of the first cylinder during timing t1 to t3. Similarly, the operations are repeated for the third, fourth, and second cylinders in that order after time t5, thus driving all four cylinders.

In general, since a conventional apparatus only generates the first ignition indication signal, time t2 as the ignition timing cannot be determined accurately. In contrast to this, the apparatus in FIG. 1 generates a second ignition instruction signal in addition to the first signal, thus allowing precise control of the ignition timing. In addition, since the primary coil current of the conventional apparatus has a constant maximum value, the spark energy and trigger voltage are low. However, the apparatus in FIG. 1 is free from the above problem. Thus, a high spark energy can be obtained at an ignition timing optimal for the engine, thus improving fuel consumption and reducing harmful components in the exhaust gas.

Figure 9:
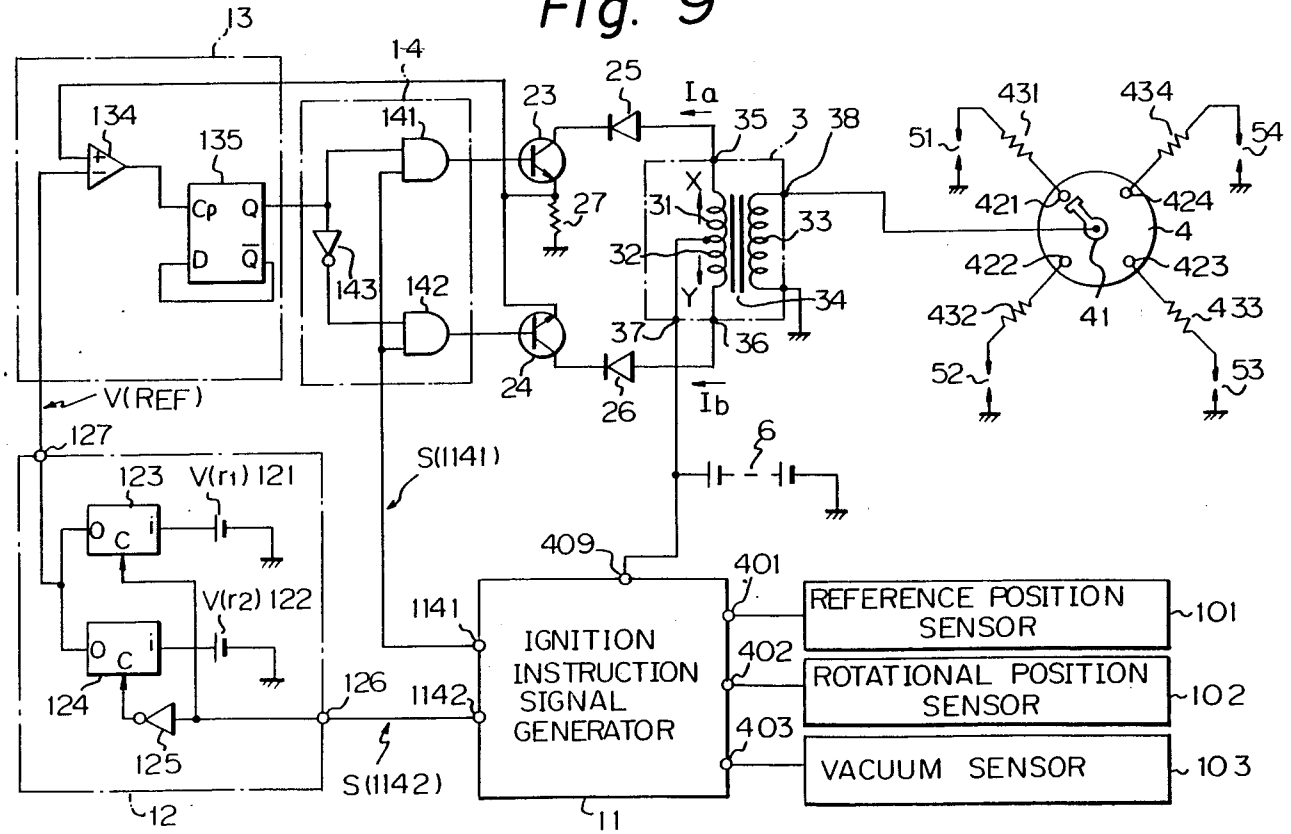
FIGS. 9 and 10 are circuit diagrams of other embodiments of the present invention.

FIG. 9 shows an ignition control apparatus for an internal combustion engine according to another embodiment of the present invention. In the apparatus shown in FIG. 9, the emitters of power transistors 23 and 24 are commonly connected to a single current detection resistor 27. The terminal voltage across the resistor 27 is supplied to the non-inverting input terminal of a single comparator 134, whose output is applied to a clock input terminal Cp of a data flip-flop 135. The $\overline{Q}$ output from the flip-flop 135 is supplied to a data input terminal D thereof, and the Q output therefrom is supplied to a logic circuit 14 as an output from a discriminator 13.

In the apparatus in FIG. 9, the primary currents of primary coils 31 and 32 are detected by the single resistor 27. When the primary currents exceed s preset level, a comparator 134 generates a "1" level pulse output, thus inverting the Q output from the data flip-flop 135 from "0" to "1" level. In this manner, the power transistors 23 and 24 are alternatively switched through the logic circuit 14.

Figure 10:
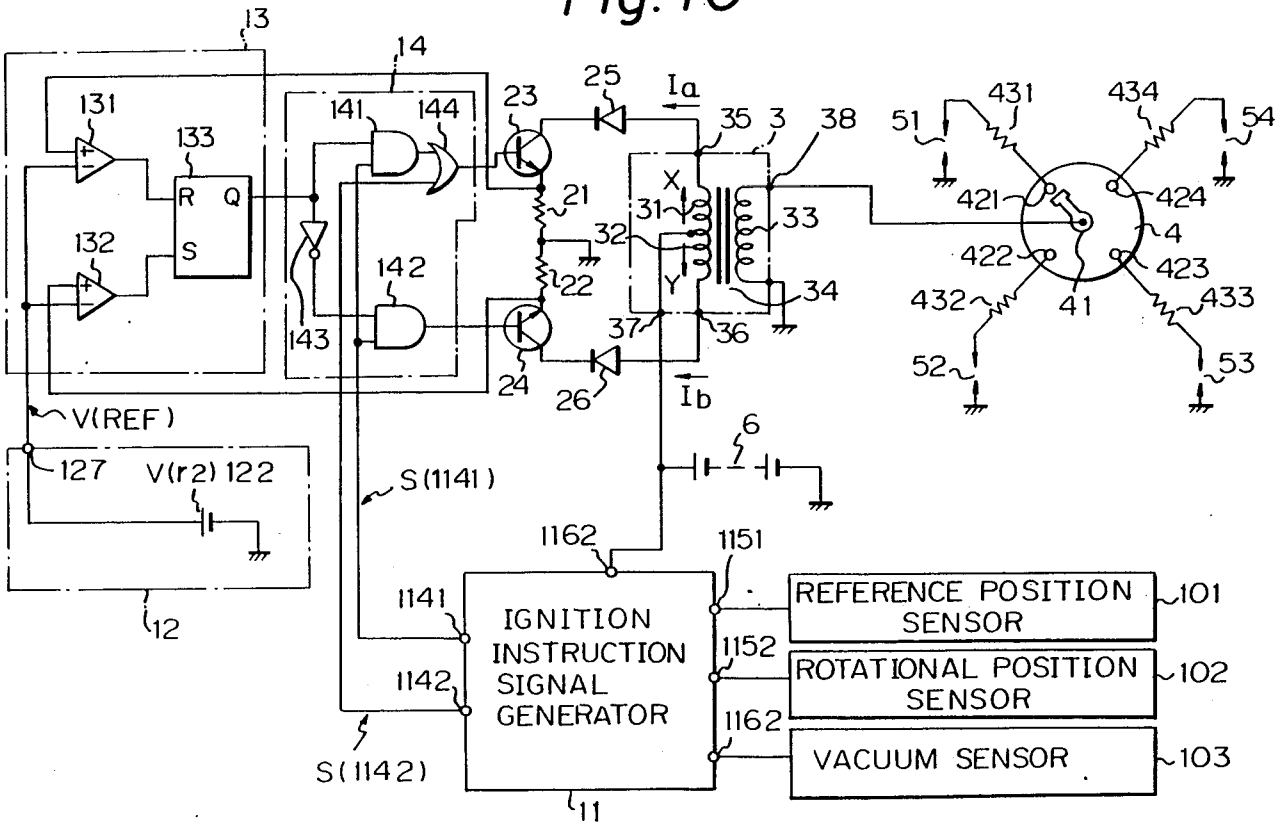

FIG. 10 shows an ignition control apparatus for an internal combustion engine according to another embodiment of the present invention. In the apparatus shown in FIG. 10, a reference voltage generator 12 always generates a single reference voltage V(r2), which is equal to the voltage drop generated across current detection resistors 21 and 22 shown the primary coil current is 16 A. The output from an AND gate 141 of a logic circuit 14 is connected to one input of an OR gate 144, the other input of which receives a second ignition instruction signal from an ignition instruction signal generator 11. The output from the OR gate 144 is connected to the base of the power transistor 23. In this embodiment, a first ignition instruction signal from the generator 11 is kept at the "1" level during the interval from a spark timing t2 to an AC discharge termination timing t3, i.e., during the interval corresponding to the "1" level interval of the first ignition instruction signal shown in FIG. 6(1) from which the "1" level interval of the second ignition instruction signal shown in FIG. 6(2) is omitted.

In the apparatus in FIG. 10, the power transistor 23 is enabled through the OR gate 144 in response to the second ignition instruction signal generated at timing t1, and is disabled at the ignition timing t2. Since the "1" level interval of the second ignition instruction signal is set long enough to increase the primary coil current from the ignition coil 3 to a given level, e.g., 18 A, the voltage across the resistor 21 becomes higher than the reference voltage from the generator 12, corresponding to the 16 A primary current. Thus, the output signal from the comparator 131 goes to "1" level, thereby resetting the flip-flop 133. When the first ignition instruction signal goes to "1" level at the ignition timing t2, the currents from the primary coils 31 and 32 alternatively switch the power transistors 23 and 24 every time they reach a given level (16 A) during the "1" level in interval of the first ignition instruction signal.

We claim:

1. An apparatus for controlling ignition in an internal combustion engine, comprising a DC power supply for generating a DC voltage; an ignition coil having first and second primary coils and a secondary coil; a first switching element constituting a first closed circuit including said DC power supply and said first primary coil; a second switching element constituting a second closed circuit including said DC power supply and said second primary coil; a reverse-flow preventing element for setting a current-flow direction in said first and second closed circuits to one direction; a current detection element for detecting the current flowing through said first and second closed circuits; ignition instruction signal generating means for repeatedly generating a first ignition instruction signal instructing an AC discharging duration and a second ignition instruction signal instructing a first time length of flow of the primary current at each spark timing; and ignition control circuit means for causing said first and second switching elements to perform a push-pull operation for a predetermined period upon reception of a given ignition instruction signal, wherein, when it is detected from a current detection signal from said current detection element upon reception of said first ignition instruction signal that the current of one of said first and second closed circuits has reached a predetermined value, a signal for turning OFF one of said first and second closed circuits is supplied to one of said first and second switching elements and a signal for turning ON the other closed circuit is supplied to the other switching element to enable a push-pull operation of said switching elements, so that one of the switching elements is turned ON in response to said second ignition instruction signal for the time length of flow of the primary current, and is then turned OFF.

2. An apparatus according to claim 1, wherein said ignition control circuit means includes a preset value generating circuit for generating a first preset current value upon reception of said second ignition instruction signal and thereafter generating a second preset current value smaller than the first preset current value; a discrimination circuit for receiving the preset current values from said preset value generating circuit and the current detection signal from said current detection element so as to generate an output which is inverted each time the current of said first and second closed circuits reach the preset current values generated by said present value generating circuit; and a logic circuit for receiving the output signal from said discrimination circuit and said first ignition instruction signal so as to switch said first and second switching elements using the alternatively inverted output signal from said discrimination circuit while said first ignition instruction signal is received.

3. An apparatus according to claim 1, wherein a function of said ignition instruction signal generating means comprises the steps of:

carrying out interruptions at every predetermined crank angle;

calculating a rotational speed or a rotational angle of the internal combustion engine;

obtaining data corresponding to an intake pipe negative pressure;

obtaining an optimal ignition angle based on the data indicating the rotational speed and the intake pipe negative pressure;

obtaining data corresponding to a battery voltage;

obtaining an optimal ignition delay angle based on the data indicating the rotational speed and the battery voltage;

calculating an angle of the start of the ignition coil energization based on the optimal ignition angle and the optimal spark delay angle; and generating as said second ignition instruction signal a signal of a predetermined potential based on the calculated angle of the start of the ignition coil energization during a period from the start of ignition coil energization to the start of ignition, and generating as said first ignition instruction signal a signal of a predetermined potential during the period from the start of ignition coil energization to the termination of spark plug discharging.

4. An apparatus according to claim 2, wherein said first and second switching elements are transistors.

5. An apparatus according to claim 2, wherein said preset value generating circuit comprises analog switches, output terminals of said analog switches being commonly connected to the output terminal of said preset value generating circuit, reference voltages are applied to input terminals of said analog switches, and a NOT gate connected between the input terminal of said preset value generating circuit and the control terminal of one of said analog switches, the control terminal of the other of said analog switches being connected directly to the input terminal of said preset value generating circuit.

6. An apparatus according to claim 2, wherein said discrimination circuit comprises comparators, the non-inverting input terminals of said comparators receiving the voltage across the current detection elements for detecting the current flowing through the first and second closed circuits, the inverting input terminals of said comparators receiving reference voltages from the present value generating circuit, and a flip-flop circuit the reset and set input terminals of said flip-flop circuit receiving the output signals of said comparators, the Q output terminal of said flip-flop circuit delivering the output signal of said discrimination circuit.

7. An apparatus according to claim 2, wherein said logic circuit comprises a first and second AND gates and a NOT gate, said NOT gate being connected between the input terminal of said logic circuit and one input terminal of said second AND gate, one input terminal of said first AND gate being connected directly to the input terminal of said logic circuit, the other input terminals of said first and second AND gates receiving a first ignition instruction signal from the ignition instruction signal generating means, the output terminals of said first and second AND gate delivering the output signals of said logic circuit.

8. An apparatus according to claim 6, wherein the emitters of transistors serving as said first and second switching elements are commonly connected to said current detection element, and the voltage from said current detection element is applied to an input terminal of a comparator included in said discrimination circuit, an output from said comparator is applied to a clock input terminal of a flip-flop circuit included in said discrimination circuit, and a Q output from said flip-flop circuit is applied to the said logic circuit.

9. An apparatus according to claim 2, wherein said preset value generating circuit always generates a single reference voltage, and said logic circuit comprises an OR gate for receiving an output from a single AND gate and the ignition instruction signal from said ignition signal generating circuit.

* * * * *